United States Patent [19]

Furlong

[11] Patent Number: 4,909,517

[45] Date of Patent: Mar. 20, 1990

[54] ROLLING BALL GAME

[76] Inventor: Donald F. Furlong, 9300 Greenwood Rd., Grass Lake, Mich. 49240

[21] Appl. No.: 288,993

[22] Filed: Dec. 23, 1988

[51] Int. Cl.[4] ..... A63F 7/02

[52] U.S. Cl. ..... 273/352

[58] Field of Search ..... 273/399–402, 273/39, 352, 129, 85 R, 124 R

[56] References Cited

U.S. PATENT DOCUMENTS

| | | | |
|---|---|---|---|
| 823,049 | 6/1906 | Kelly . | |
| 836,561 | 11/1906 | Bush | 273/352 |
| 961,595 | 6/1910 | Fitch | 273/124 R |
| 1,006,314 | 10/1911 | Talbert | 273/39 |
| 1,106,530 | 8/1914 | Wilson | 273/352 X |
| 2,014,899 | 9/1935 | Kroker | 273/39 |
| 2,067,732 | 1/1937 | Rimmer . | |
| 2,472,719 | 6/1949 | Mysels . | |
| 2,496,345 | 2/1950 | Hatherell | 273/129 S |
| 3,941,381 | 3/1976 | Trbovich | 273/352 X |
| 3,961,793 | 6/1976 | Zanders | 273/124 R |

*Primary Examiner*—Paul E. Shapiro

*Attorney, Agent, or Firm*—Beaman & Beaman

[57] ABSTRACT

A rolling ball game of high quality construction utilizing a ball-rolling surface haivng a launching end and a ball elevating and reversing end wherein balls projected across the surface are elevated, reversed and fall upon a playing member having a game field defined thereon including ball-receiving recesses. Optional playing member may be readily substituted for each other to vary the nature and scoring of the game. Preferably, a cue is employed to project the ball across the rolling surface.

2 Claims, 1 Drawing Sheet

ROLLING BALL GAME

BACKGROUND OF THE INVENTION

Rolling ball games wherein a spherical ball is rolled across a surface and then elevated to project through the air prior to landing on a target have long been popular as epitomized by the famous SKEE games popular in amusement parks, and such games may use a ramp to elevate the ball while moving in the direction originally projected, or a reversing curve may be employed wherein the projected ball is elevated while moving in a direction toward the player. Games of this general type are shown in U.S. Pat. Nos. 823,049; 1,106,530; 2,067,732 and 2,472,719.

It is an object of the invention to provide a rolling ball game of high quality wherein the game apparatus is in the form of furniture and is suitable as a decorative piece in living quarters.

A further object of the invention is to provide a rolling ball game wherein a spherical ball is rapidly moved across a rolling surface, preferably by a cue, and at its end remote from the player, the rolling surface is in the configuration of a concave reversing curve which elevates the ball and directs the ball movement back toward the player while the ball falls from the reversing curve.

Yet a further object of the invention is to provide a rolling ball game having a playing member including ball-receiving recesses, the playing member being removably mounted upon the game apparatus frame, alternate playing members having different scoring systems and modes of play being readily substituted for each other.

In the practice of the invention the game includes a frame, preferably of substantial size and weight, and preferably, mounted upon its own legs wherein the frame will be positioned at an elevation convenient to the player's height. The frame is of an elongated configuration having a flat ball-rolling surface defined thereon, and the frame includes lateral sides which vertically extend from the ball-rolling surface confining a ball thereon.

The rolling surface includes a launching end having a tee for positioning a ball which may be struck by a cue to roll the ball toward the ball-reversing end of the rolling surface. The reversing end consists of a concave curve tangential with the planar rolling surface having a terminal end projecting back toward the player and launching end. A ball moving across the rolling surface at sufficient velocity is elevated by the reversing curve and then falls back toward the rolling surface.

A playing member is supported upon the frame above the rolling surface so that balls may roll thereunder, and below the terminal end of the ball-reversing end of the rolling surface, so as to receive balls dropping from the curve. The playing member includes a plurality of ball-receiving recesses which may be marked with various indicia, or be of a particular configuration, to provide the type of game desired. The playing member rests upon support means defined on the frame lateral sides, and may be readily removed and replaced by another playing member having a different playing surface defined thereon. Thus, the nature of the game being played may be very quickly changed, and by using a plurality of playing members a wide variety of games are available when using the basic apparatus.

DESCRIPTION OF THE DRAWINGS

The aforementioned objects and advantages of the invention will be appreciated from the following description and accompanying drawings wherein.

DESCRIPTION OF THE PREFERRED EMBODIMENTS

Figure 1:
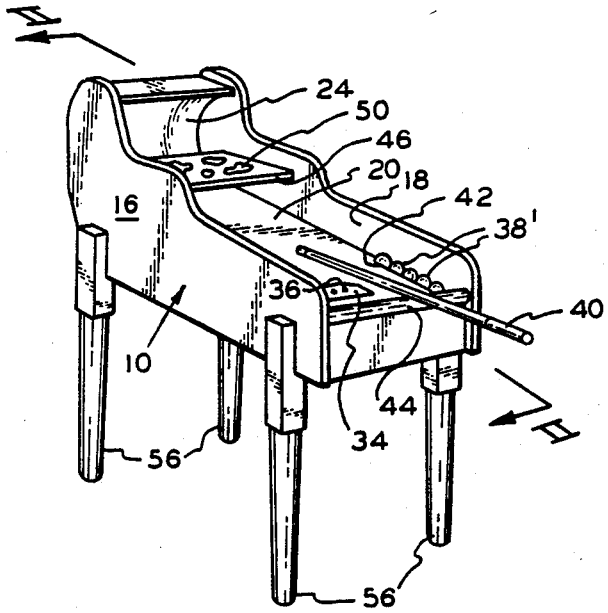
FIG. 1 is a perspective view of a rolling ball game in accord with the inventive concepts.
Figure 2:
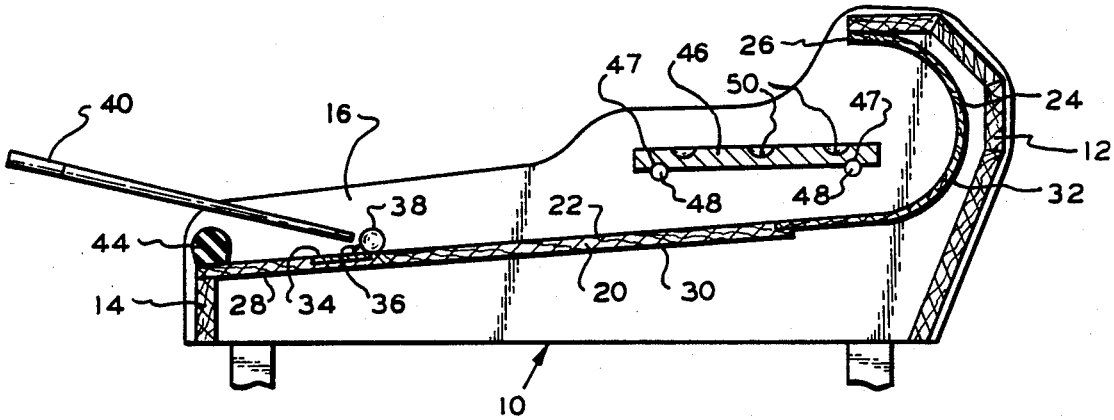
FIG. 2 is an elevational, sectional view of the game as taken along Section II—II of FIG. 1.

With reference to FIGS. 1 and 2, a rolling ball game in accord with the invention includes a frame generally indicated at 10 which is of an elongated configuration having base end pieces 12 and 14, FIG. 2, and vertically extending lateral sides 16 and 18. The frame includes a flat panel 20 defining a ball-rolling surface 22 between the lateral sides 16 and 18 and the end of the ball-rolling panel includes a portion 24 of arcuate concave configuration adjacent the end piece 12 having an end 26. The portion of the ball-rolling panel 20 adjacent end piece 14 defines a launching end 28 for the ball, a central region is defined at 30, and a ball-reversing end region 32 is formed by the portion 24. The portion 24 is tangential with the flat portion of the panel 20 wherein a ball rolled from the launching end 28 to the ball-reversing end 32 passes through a smooth transition toward the terminal end 26 of the portion 24. Preferably, the ball-rolling surface 22 is covered with a felt or fabric material similar to that of a billiard table or the like.

Preferably, the rolling surface 22 supports a ball tee 34 consisting of a pair of spaced vertically extending projections 36 against which the ball 38 may rest prior to being struck by the end of the cue 40. Of course, the ball 38 may be rolled across the surface 22 by hand and the use of a cue is not required. The panel 20 may include a recess 42, FIG. 1, in which a plurality of balls 38 may be stored. A bumper 44 extends across the top of the launching end 28 of the panel 20 between sides 14 and 16 to engage balls rolling back on the surface 22 which were not projected with sufficient force to permit them to fall upon the playing member. As will be noted from FIG. 2, the panel 20 has a slight inclination with the lowermost portion being adjacent the launching end to permit the balls to roll theretoward.

A playing member or board 46 is supported upon the frame lateral sides 16 and 18 below the panel portion terminal end 26. The playing member 46 has locating recesses 47 receiving support members 48 located upon each lateral side, and the cooperation between the playing member and the support projections 48 is such that the playing member will be firmly held in position but may be readily removed therefrom by an upward movement. As will be appreciated from FIG. 1, the width of the playing member 46 is substantially equal to the spacing between the frame lateral sides.

The upper surface of the playing member includes recesses 50 of such shape and configuration as to readily receive balls 38 falling thereon as they drop from the arcuate portion 24 as the balls approach or pass over the terminal end 26. The recesses 50 may be assigned various values, and scoring is achieved by adding the values of the recesses in which balls come to rest. Preferably the playing member is slightly inclined and if a ball falling upon the playing member 46 is not received within a recess it will fall to the playing surface and return to the bumper 44 for another turn.

Figure 3:
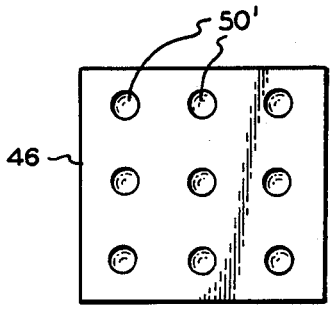
FIG. 3 is a plan view of one form of the playing member.
Figure 4:
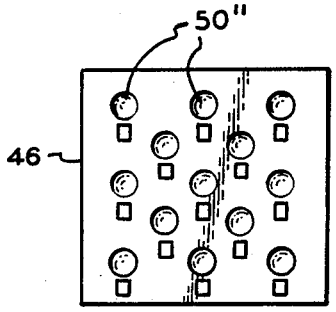
FIG. 4 is a plan view of a variation of the playing member.
Figure 5:
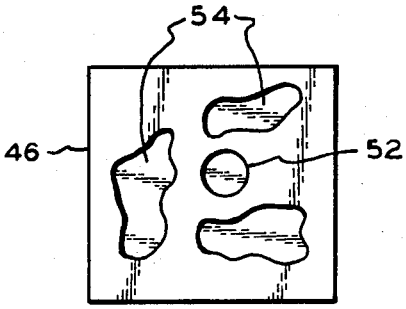
FIG. 5 is a plan view of another variation of the configuration of the playing member.

The configuration of the recesses upon the upper surface of the playing member 46 may be varied. For instance, as shown in FIG. 1, a fewer number of recesses may be used than the embodiment of FIG. 3 having recesses 50', and in FIG. 4 the various recesses 50'' are assigned playing card designations wherein a game of poker or the like can be played. Also, the playing member upper surface may include a configuration simulating a golf hole 52 as shown in FIG. 5, and the sand traps 54 may be recessed to retain the ball in the event the ball is not received within the "hole" 52.

The frame 10 is preferably formed of a high quality building material, such as wood, so that the apparatus has an attractive appearance. Also, four attractive and substantial legs 56 may be used to support the frame so that it becomes a self-standing furniture piece.

By using various playing members 46 the apparatus is capable of playing a variety of "games" in order to improve interest and skills. As balls 38 not retained on the playing member 46 are automatically returned to the player for reuse, and as the balls will be confined to the upper surface 22, the storage recess 42, or the playing member, the balls are readily accessible, and the game permits players of only average coordination to quickly develop acceptable skills.

It is appreciated that various modifications to the disclosed embodiment may be apparent to those skilled in the art without departing from the spirit and scope of the invention.

I claim:

1. A rolling ball game comprising, in combination, a frame, an elongated ball-rolling surface defined on said frame having a ball-launching end, a central region and a ball-reversing end, said ball-rolling surface being inclined with respect to the horizontal, said ball-launching end being lower than said ball-reversing end, ball-positioning means defined upon said ball-rolling surface adjacent said ball-launching end, a bumper extending across the width of said ball-launching end for confining balls on said ball-rolling surface, said ball-reversing end including a concave arcuate portion elevating and substantially reversing the direction of movement of a ball rolling from said launching end to said reversing end, a playing member removably mounted upon said frame adjacent said ball-reversing end receiving a ball from said concave portion, said ball-reversing end concave arcuate portion being tangential to said central region and having an outer end extending in the general direction of said ball-rolling surface launching end, said ball-reversing end concave arcuate portion and said outer end being fully confined within said frame, said central region and said outer end defining a ball-reversing end throat, said playing member being at least partially located within said throat between said inner and outer ends and slightly inclined to the horizontal in the direction of the length of said ball-rolling surface, said frame including lateral sides, said ball-rolling surface being located between said lateral sides projections defined upon said frame lateral sides above said ball-rolling surface and extending inwardly from said lateral sides over said ball-rolling surface, said playing member being removably supported upon said projections, recesses defined on said playing member cooperating with said projections locating said playing member relative to said projections, and ball-receiving means defined upon said playing member.

2. In a rolling ball game as in claim 1, said playing member being of a substantially planar configuration having an upper surface disposed toward said outer end, said ball-receiving means defined in said upper surface.

* * * * *